US010555645B1

(12) United States Patent
Danti

(10) Patent No.: US 10,555,645 B1
(45) Date of Patent: Feb. 11, 2020

(54) APPARATUS AND METHOD FOR A PORTABLE URINAL KIT

(71) Applicant: Stephen Danti, North Judson, IN (US)

(72) Inventor: Stephen Danti, North Judson, IN (US)

( * ) Notice: Subject to any disclaimer, the term of this patent is extended or adjusted under 35 U.S.C. 154(b) by 0 days.

(21) Appl. No.: 16/044,514

(22) Filed: Jul. 25, 2018

(51) Int. Cl.
*A47K 11/12* (2006.01)

(52) U.S. Cl.
CPC ..... *A47K 11/12* (2013.01)

(58) Field of Classification Search
CPC ..... A47K 13/12
USPC ..... 4/144.1
See application file for complete search history.

(56) References Cited

U.S. PATENT DOCUMENTS

| | | | | |
|---|---|---|---|---|
| 1,702,542 | A | 2/1929 | Hodgson | |
| 4,606,080 | A | 8/1986 | Clementino | |
| 5,285,532 | A * | 2/1994 | Sealy | A47K 11/12 4/144.1 |
| 6,021,531 | A * | 2/2000 | Kirko | A47K 11/12 4/144.1 |
| 6,374,432 | B1 | 4/2002 | Morris | |
| 8,104,106 | B2 | 1/2012 | Anderson | |
| 8,166,579 | B2 * | 5/2012 | Mehta | E03D 11/025 4/144.1 |
| 9,386,891 | B1 * | 7/2016 | Guralnik | A61B 10/007 |
| 2005/0262621 | A1 | 12/2005 | Dalton | |
| 2009/0019632 | A1 | 1/2009 | Mineo | |
| 2009/0260140 | A1 * | 10/2009 | Birbara | A47K 11/12 4/144.1 |
| 2010/0275352 | A1 * | 11/2010 | Beeson | A47K 11/00 4/144.1 |

FOREIGN PATENT DOCUMENTS

| | | | |
|---|---|---|---|
| GB | 279292883 | A | 6/1928 |

* cited by examiner

*Primary Examiner* — Lori L Baker

(57) ABSTRACT

A portable urinal kit is presented. The portable urinal kit contains a receiving vessel which can be secured to a support member. The receiving vessel has a top that is open and can receive urine or waste from a user. The receiving vessel has a drain hole that is connected to a drain hose. The drain hose may be connected to a dry well.

10 Claims, 3 Drawing Sheets

APPARATUS AND METHOD FOR A PORTABLE URINAL KIT

FIELD OF THE INVENTION

The present invention relates generally to transportable toilet facilities, and particularly to a portable urinal kit that is easily transportable.

BACKGROUND

Transportable toilets are now in widespread use. Many jurisdictions require contractors to provide transportable toilets at construction sites where large numbers of works will be employed over a substantial period. Transportable toilets are also utilized at concerts and other large gatherings to supplement permanently install toilet facilities.

Transportable toilets typically comprise an upright rectangular structure. A door is openable to provide access and closable to provide privacy. The device is entirely self-contained and is removed from the location at which it is used whenever waste disposal is required or the event has concluded.

Although transportable toilets are well suited for use at larger construction sites, concerts, etc., they are not well adapted for use in conjunction with smaller projects such as swimming poll construction, driveway and sidewalk construction, exterior painting of office buildings or residences, landscaping installation and maintenance, etc. It is simply uneconomical to deliver a transportable toilet to such a location and then to retrieve the portable toilet after a relatively short time and relatively little use.

Further, those who camp or are away from home where there is not transportable toilets or permanent toilets available must also find a location to relieve themselves.

Nevertheless, when a location, site, or even does not justify the use of a transportable toilet, the people at those locations need to periodically relieve themselves. Heretofore this has been accomplished either by leaving the site to visit a nearby service station or convenience store, or by finding a hopefully private location on the job site itself. Both solutions to the problem are unsatisfactory.

DETAILED DESCRIPTION

Reference will now be made in detail to the present preferred embodiments, examples of which are illustrated in the accompanying drawings. All terms in the plural shall also be taken as singular and vice-versa. Further, any reference to he shall also be applicable to she and vice-versa.

Figure 1:
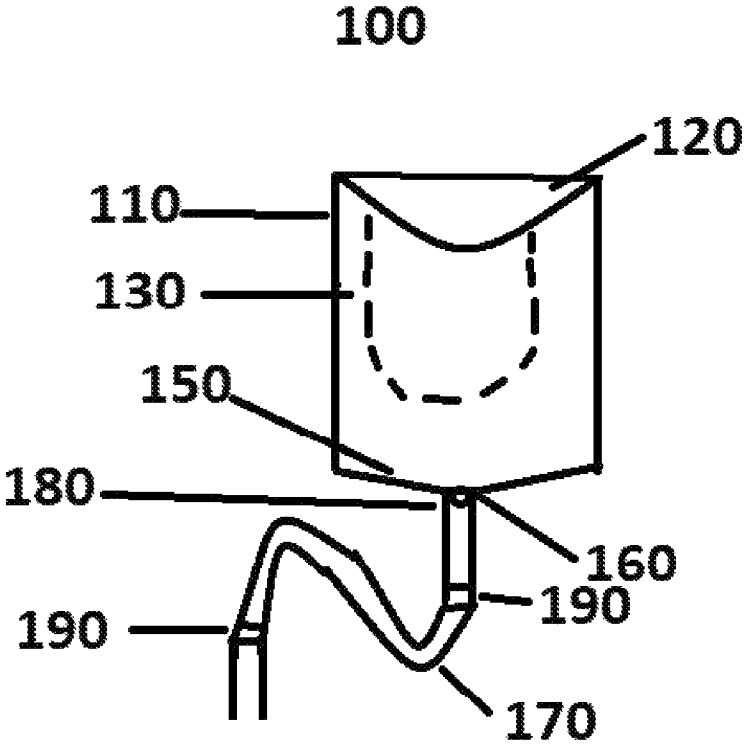
FIG. 1 is a view of a receiving vessel of an exemplary urinal kit.

Referring now to FIG. 1, an exemplary view of a receiving vessel is presented. The portable urinal kit 100 has a receiving vessel 110. The receiving vessel 100 is used to receive urine or other bodily waste from a user. The receiving vessel may contain a solution for minimizing the scent of the odor from the receiving vessel 110 after it has been utilized by a user. The receiving vessel 110 may be made from any environmentally friendly material. The environmentally friendly material may be heavy plastic, poly-vinyl chloride (PVC), etc.

The receiving vessel 110 has a top 120. The top 120 of the vessel 110 may be oval to easily receive the urine or waste of a user. The shape of the receiving vessel 110 may be any shape including round, oval, a dip in one portion of the top, etc.

Figure 2:
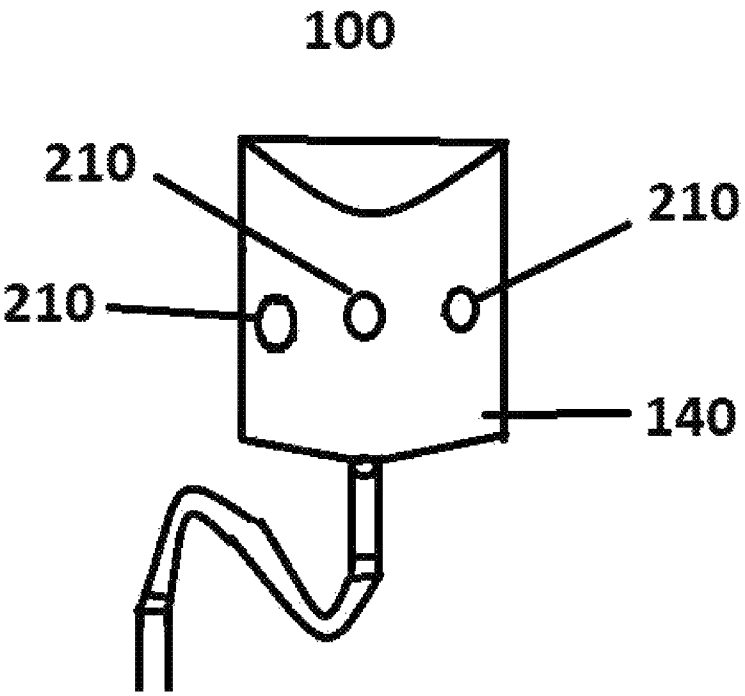
FIG. 2 is a view of opposite side of the receiving vessel shown in FIG. 1.

The receiving vessel has a front side 130 and a back side 140 (see FIG. 2). The front side may be smooth, have bumps, have ridges, etc. The receiving vessel 110 has a bottom portion 150. The bottom portion 150 of the receiving vessel 110 is closed except for a drain hole 160. The drain hole 160 may be round, rectangular, square, etc. The drain hole 160 is used to have the urine or waste removed from the receiving vessel 110.

The drain hole 160 of the receiving vessel 110 is coupled to a first end 180 of a drain hose 170. The drain hose 170 is used to control the removal of the urine or waste from the receiving vessel 110. The drain hose 170 may have one or more straps 190 and is used to secure the drain hose 170 from moving and potentially becoming uncoupled to the receiving vessel 110. The one or more straps 190 may be Velcro straps, zip ties, string, etc.

Moving now to FIG. 2, the back side 130 of the receiving vessel 110 is presented. The back side 130 of the receiving vessel 110 has one or more connection devices 210. The one or more connection devices are coupled to a support member, not shown.

The one or more connection devices 210 secure the receiving vessel 110 to the support member such that the receiving vessel 110 does not move in any direction while in use. The one or more connecting devices 210 of the back side 130 of the receiving vessel 110 may be straps, Velcro, straps with snaps, etc.

Figure 3:
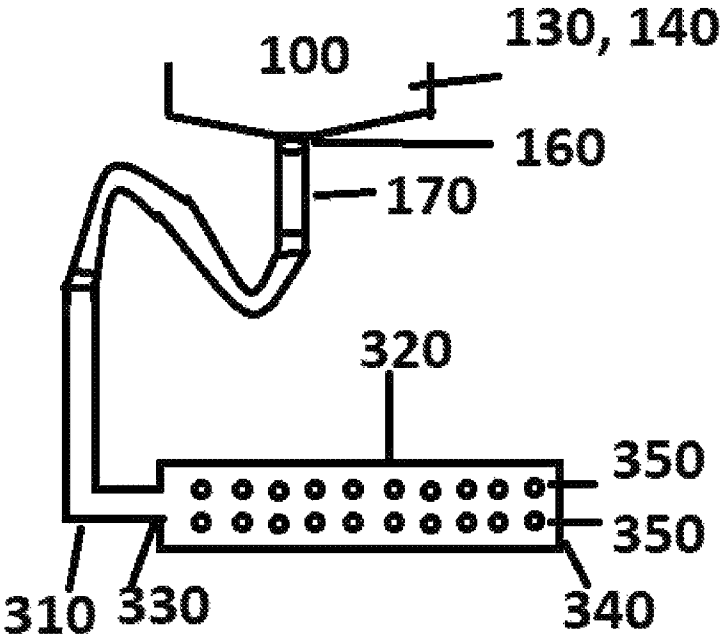
FIG. 3 is an exemplary view of a connection of the receiving vessel to a dry well.

Referring to FIG. 3, an exemplary view of a connection of the receiving vessel 110 to a dry well 320 is shown. The receiving vessel 110 is communicably coupled to the dry well 320 by the drain hose 170.

The first end 180 of the drain hose 170 is coupled to the drain hole 160 of the receiving vessel 110. A second end 310 of the drain hose 170 is coupled to the first end 330 of the dry well 320. This allows the urine or waste of a user to flow from the receiving vessel 110 to the dry well 320.

The second end 340 of the dry well 320 is generally closed. The dry well 320 has seepage holes 350 for allowing the urine or waste to be dispersed into the ground or other matter the dry well 320 has been placed on or in. Generally, a hole is dug into the ground, the rock or other elements may be placed into the ground and then the dry well 320 is placed into the hole. The dry well 320 may be covered. At some later time, the user may elect to recover the dry well 320 by removing it from the ground. The dry well 320 is generally made of a material that is sanitary and does not capture odor. The dry well 320, as is the receiving vessel 110 and drain hose 170, are cleaned at the end of each use.

The features described with respect to one embodiment may be applied to other embodiments or combined with or interchanged with the features of other embodiments, as appropriate, without departing from the scope of the present invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A portable urinal kit, the portable urinal kit comprising:

a receiving vessel;

a support member, the support member being coupled to the receiving vessel;

the receiving vessel having an open top and a bottom portion, the open top being for receiving liquid and the bottom portion being for draining the receiving vessel;

a drain hose, the drain hose coupled to the bottom portion of the receiving vessel;

a dry well, the dry well being coupled to the opposite end of the drain hose from the bottom portion of the receiving vessel, wherein the dry well having seepage holes to aid in drainage; and at least one strap, the at least one strap being coupled to the drain hose for securing the drain hose.

2. The portable urinal kit of claim 1, wherein the receiving vessel being coupled to the support member by suction cups.

3. The portable urinal kit of claim 1, wherein the receiving vessel being coupled to the support member by the at least one strap.

4. The portable urinal kit of claim 1, wherein the receiving vessel being coupled to the support member by screws.

5. The portable urinal kit of claim 1, wherein the receiving vessel being a scent minimizing solution.

6. A method for disposing of urine outdoors while minimizing scent, comprising the steps of:

placing a hollow urine collection container having a top opening and a bottom opening at a desired location above the ground;

coupling a first end of a hose to the bottom opening of the container;

placing the hose into a dry well;

passing a second end of the hose into a dry well, and burying the dry well in the ground, wherein the dry well having seepage holes to aid in drainage.

7. The method of claim 6 wherein the receiving vessel being closeable at the top opening.

8. The method of claim 6 wherein the receiving vessel having a one-way spout at the bottom opening.

9. The method of claim 6 wherein the user, after urinating and prior to closing the closeable lid and closeable spout, rinsing the container with a scent minimizing substance to further minimize odor.

10. The method of claim 6 wherein the scent minimizing rinse having a main ingredient of carbon and wherein the scent minimizing rinse being mixed with water.

* * * * *